United States Patent [19]

Reslow et al.

[11] Patent Number: 4,512,254

[45] Date of Patent: Apr. 23, 1985

[54] FOAM INK FOUNTAIN

[75] Inventors: Leif F. Reslow; Mark D. Nieman; Dean R. Swagert, all of York, Pa.

[73] Assignee: Motter Printing Press Co., York, Pa.

[21] Appl. No.: 603,507

[22] Filed: Apr. 24, 1984

[51] Int. Cl.[3] ..... B41F 9/10; B41F 9/16; B41L 27/08

[52] U.S. Cl. ..... 101/157; 101/363

[58] Field of Search ..... 101/157, 169, 170, 148, 101/153, 152, 155, 167, 363, 350, 207, 208, 210, 364; 8/149.1, 149.2, 151, 477; 68/202, 200; 118/261, 262, 258, 407

[56] References Cited

U.S. PATENT DOCUMENTS 2,971,458 2/1961 Kumins et al. ..... 101/170
3,400,658 9/1968 Gagliardi et al. ..... 101/170

*Primary Examiner*—J. Reed Fisher
*Attorney, Agent, or Firm*—Brumbaugh, Graves, Donohue & Raymond

[57] ABSTRACT

A fountain for applying a foam ink to an engraved cylinder of a rotogravure printing press includes an open ink pan into which the ink is introduced and a rotary brush for applying ink from the ink pan to the cylinder. A pre-doctor blade permits a predetermined amount of ink to pass thereby and is followed by a doctor blade for scraping excess ink from the cylinder.

5 Claims, 3 Drawing Figures

FOAM INK FOUNTAIN

BACKGROUND OF THE INVENTION

The present invention relates to printing presses and more particularly to a fountain for applying a foam ink to an engraved printing cylinder of a rotogravure printing press.

Rotogravure printing is typically done with hydrocarbon based liquid inks or water based liquid inks, which in most cases contain some volatile organic compounds as drying agents. Ink is applied to the engraved cylinder by one of the following methods: (a) immersing a portion of the cylinder in a bath of ink; (b) spraying ink onto the cylinder by means of nozzles; or (c) from a roller frictionally driven by contact with the cylinder, a portion of the roller being immersed in a bath of ink. All of these methods are designed to insure that the ink completely covers the surface of the cylinder and fills the engraved cells. In reality, however, all the systems may produce intermittent void areas known as "skips".

Another type of ink, water based foam, has proven to be an equivalent substitute for conventional hydrocarbon based rotogravure inks. But the foam ink has a relatively low mass and is adversely affected by air currents, so that the conventional bath is not suitable. This is because the laminar boundary layer of air on the surface of a rotating cylinder blows the ink away. A friction driven roller applicator squeezes the gas out of the foam breaking down the foam into a liquid, thus altering the characteristics of the foam ink so that it is unsuitable for printing. And appying foam ink through a plurality of nozzles in an attempt to avoid "skips" requires far more ink than the cylinder can accept.

The U.S. Pat. No. 4,365,968 discloses a method of treating textiles serially with two finishing agents, one or both of which are in the form of a foam. The second agent, which is always a foam, is applied before the textile has been fully dried after application of the first agent, which may be a printing composition.

The U.S. Pat. No. 4,266,976 discloses a similar method of treating textiles with foam finishing agents and describes various compositions suitable for fabrics, all of which must be stable for a relatively long period of time.

The U.S. Pat. No. 2,971,458 describes a process for coloring textiles using various foamed inks, the ink being applied to the engraved printing cylinder under pressure through an enclosed distributor box to prevent ambient air from contacting the foamed ink. Mention is made of a technique in which foam is applied to the printing cylinder by a cylindrical brush from a furnishing box, high speed beaters being provided in the box in an attempt to overcome the tendency for the air content of the foam to increase.

The U.S. Pat. No. 3,400,658 discloses a method of rotogravure printing in which a foam ink is injected and contained in a pressurized chamber in contact with the printing cylinder for a very short period of time, the chamber excluding ambient air from contact with the foam ink in the chamber. This system requires the ink to be continuously removed from the chamber to a remote compressor and recirculated to the chamber so that it is refoamed during each cycle.

SUMMARY OF THE INVENTION

The ink fountain in accordance with the invention employs a pan open to the atmosphere for containing the foamed ink prior to application to the engraved cylinder. Ink is applied to the cylinder by a brush roller mounted for rotation within the pan. A pre-doctor blade permits only a predetermined small amount of ink to pass from the relatively large mass of ink that travels with the surface of the cylinder, and this remaining small amount is doctored by a blade in contact with the cylinder surface.

The excess ink that tends to back up in front of the doctor blade is pumped through a return passage formed in the pan to the portion of the pan into which new foamed ink is introduced. Preferably the pump comprises another brush roller.

This foam ink fountain insures complete ink coverage across the entire engraved cylinder minimizing any possibility of "skips". The ink is contained within the fountain until it is consumed in the printing process, thereby eliminating the need for auxiliary pumping, conveying or compressing equipment of the prior art. Inasmuch as the pan is open to the atmosphere, problems of sealing the pan against the cylinder are avoided. The brush rollers, in addition to applying foam ink to the cylinder and controlling foam buildup near the doctor blade, agitate the ink and maintain homogeneity.

For a better understanding of the invention, reference is made to the following description of a preferred embodiment, taken in conjunction with the accompanying drawings.

DESCRIPTION OF A PREFERRED EMBODIMENT

Figure 1:
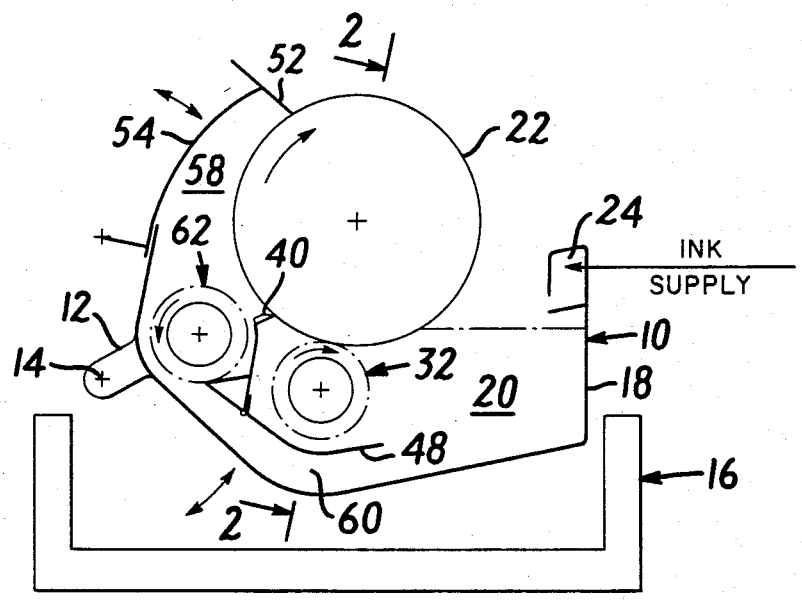
FIG. 1 is a schematic side view of a foam ink fountain in accordance with the invention.
Figure 2:
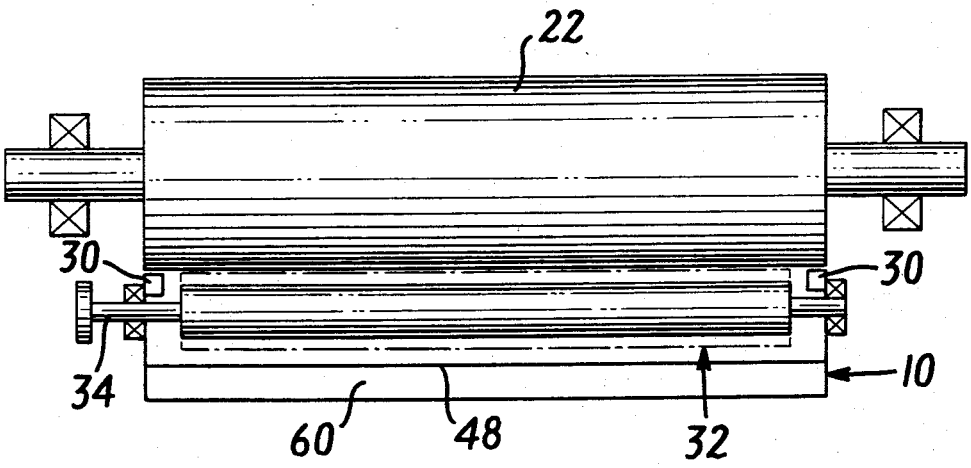
FIG. 2 is a view taken along the line 2—2 of FIG. 1 and looking in the direction of the arrows.

Referring to the drawings, an inner ink fountain 10 includes a plurality of lugs 12 by which it is pivotally mounted at 14 to a conventional outer fountain 16, which collects any ink that escapes from the inner fountain. The inner fountain 10 includes a pan 18 for containing foam ink 20 to be applied to the usual engraved printing cylinder 22 of a rotogravure press. (The pivotal mount 14 enables the inner fountain 10 to be dropped onto the outer fountain 16 when it is desired to change the cylinder 22.) The ink is supplied to the pan 18 from a manifold 24 within the pan through a pair of spaced conduits 26.

The pan 18 is open to the atmosphere between the manifold 24 and the cylinder 22, so that the difficulties of sealing the pan against the cylinder are avoided. Even so, the pan includes a pair of end plates 28 on each of which is mounted a sealing ring 30 that is closely spaced from the cylinder 22 to minimize the leakage of ink therebetween, while avoiding any wear of the cylinder surface.

The manifold 24 is supplied with ink from a conventional delivery system (not shown) that preferably includes a conventional automatic level control to maintain an operating ink level in the pan 18 that covers an applicator brush roller 32 mounted for rotation therein.

Alternatively, ink could be added manually to maintain the desired ink level. An appropriate level is indicated in phantom in FIGS. 1 and 3.

The applicator brush roller 32 applies the foam ink 20 to the printing cylinder 22, the brush roller being driven by a shaft 34 and having a plurality of bristles 36 around the periphery thereof. The aperture 38 in each end plate 28 accommodating the shaft 34 is elongated to enable adjustment of the roller 32 toward and away from the cylinder 22 to establish a slight gap between the tips of the bristles and the printing cylinder. A conventional elastomeric seal (not shown) mounted on the shaft 34 adjacent each end plate 28 contacts the end plate and prevents leakage of ink through the aperture 38.

Figure 3:
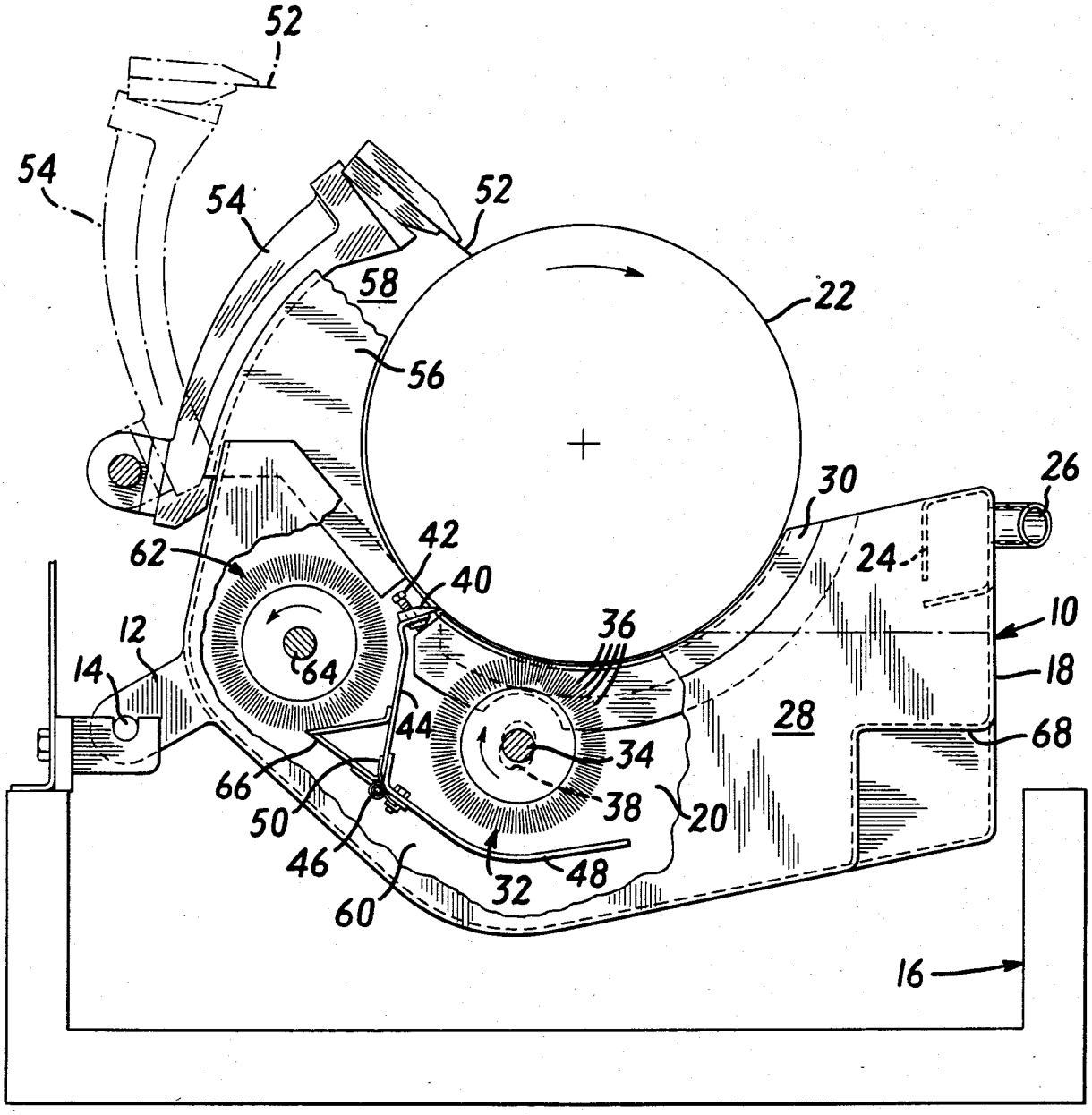
FIG. 3 is a side elevational view of the ink fountain according to the invention.

Preferably the cylinder 22 and the brush roller 32 are driven so that the peripheries thereof move in the opposite directions, as indicated in FIGS. 1 and 3. The surface speed of the brush roller 32 may be approximately one tenth that of the printing cylinder 22. Thus, the surface speed of the printing cylinder may be approximately 2000–2400 feet per minute while that of the brush roller is approximately 200 feet per minute for a foam ink having an expansion ratio of volume of air to volume of liquid in the range of approximately 5:1 to 8:1. For example, a foam ink containing 1/6 gallon liquid and 5/6 gallon air would have an expansion ratio of 5:1.

The relatively large mass of ink that travels with the surface of the cylinder 22 is reduced by a conventional pre-doctor or pre-wipe blade 40, which may be adjusted to provide a gap between it and the cylinder 22 of approximately 0.010–0.060 inch, for example. The adjustment of the pre-doctor blade is made with a jack screw 42 threadedly mounted at each end of the blade and adapted to engage the opposed facing end surface of the sealing ring 30.

The pre-wipe blade is mounted along the end of an elongated arm 44 that is pivoted by a hinge 46 mounted on a dividing wall 48 that extends across the interior of the pan 18 from one end plate 28 to the other. A plurality of torsional springs 50 mounted around the hinge 46 act on the arm 44 to bias the jack screws 42 against the sealing rings 30 to establish the desired gap between the pre-wipe blade and the cylinder 22.

The pre-wipe blade 40 permits only a predetermined small amount of ink to pass thereby and thus controls the amount of foam ink that travels with the surface of the cylinder 22 to a conventional doctor blade 52 in contact with the cylinder surface. The doctor blade 52 is pivotally mounted from an extended doctor blade support 54, which mounts a pair of end plates 56 that with the support 54 enclose a chamber 58 in which excess foam ink can accumulate.

Eventually the excess ink in the chamber 58 is pumped to a return passageway 60 that is defined by the dividing wall 48 and the bottom of the pan 18 by a brush roller 62 mounted on a shaft 64. The brush roller pump 62 is rotated so as to move the ink away from the surface of the cylinder 22. A blade 66 mounted on the arm 44 extends to and wipes off the bristles of the roller 62, and guides the ink into the passageway 60. The ink exiting the passageway 60 together with new ink supplied from the manifold 24 are applied to the cylinder 22 by the applicator brush roller 32.

The applicator brush roller 32 and the brush roller pump 62 are driven by a pair of motors (not shown) which are mounted on the exterior of the inner fountain 10 where it is relieved at 68 to accommodate the motors. A conventional drive (not shown) couples each motor with a different one of the shafts 34 and 64.

It will be understood that the above described foam ink fountain is merely exemplary and that those skilled in the art may make many variations and modifications without departing from the spirit and scope of the invention. For example, the brush roller pump may be replaced by another type of pump, such as a screw type conveyor. All such modifications and variations are intended to be within the scope of the invention as defined in the appended claims.

We claim:

1. A fountain for applying a foam ink to an engraved cylinder of a rotogravure printing press comprising an open ink pan disposed below the engraved cylinder, means for supplying the foam ink to the ink pan, rotary brush means for applying foam ink from the ink pan to the engraved cylinder, a pre-doctor blade disposed in adjacent spaced relation to the engraved cylinder and arranged, in the direction of rotation thereof, following the rotary brush means, the pre-doctor blade permitting a predetermined amount of foam ink to pass thereby, a doctor blade bearing against the engraved cylinder for scraping excess ink therefrom, the doctor blade being arranged, in the direction of rotation of the engraved cylinder, spaced from and following the pre-doctor blade, and pump means for moving foam ink from the space between the pre-doctor blade and the doctor blade to the rotary brush means.

2. The fountain according to claim 1 wherein the rotary brush means is driven so that the periphery thereof moves in a direction opposite to that of the surface of the engraved cylinder.

3. The fountain according to claim 1 wherein the pump means includes rotary brush means.

4. The fountain according to claim 3 wherein the pump rotary brush means is adjacent the pre-doctor blade and rotates in the opposite direction from the direction of rotation of the engraved cylinder and the ink applying rotary brush means.

5. The fountain according to claim 4 including means for doctoring foam ink from the pump rotary brush means and means forming a passageway for conducting foam ink from the doctoring means to the portion of the ink pan into which the foam ink is introduced by the ink supplying means.

* * * * *